US008979567B2

(12) United States Patent
Kamiya et al.

(10) Patent No.: US 8,979,567 B2
(45) Date of Patent: Mar. 17, 2015

(54) LEVER TYPE CONNECTOR

(75) Inventors: Jun Kamiya, Makinohara (JP); Yukihiro Takagi, Tokyo (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/808,188

(22) PCT Filed: Jul. 5, 2011

(86) PCT No.: PCT/JP2011/065401
§ 371 (c)(1),
(2), (4) Date: Jan. 3, 2013

(87) PCT Pub. No.: WO2012/005267
PCT Pub. Date: Jan. 12, 2012

(65) Prior Publication Data

US 2013/0109215 A1 May 2, 2013

(30) Foreign Application Priority Data

Jul. 6, 2010 (JP) ..... 2010-153786

(51) Int. Cl.
*H01R 13/629* (2006.01)

(52) U.S. Cl.
CPC .... *H01R 13/62977* (2013.01); *H01R 13/62938* (2013.01)
USPC ..... 439/338; 439/157

(58) Field of Classification Search
USPC ..... 439/157, 159, 338, 160
See application file for complete search history.

(56) References Cited

U.S. PATENT DOCUMENTS

| | | | | |
|---|---|---|---|---|
| 5,695,349 | A * | 12/1997 | Taguchi et al. | 439/157 |
| 6,644,992 | B2 * | 11/2003 | Maegawa | 439/157 |
| 6,679,711 | B2 * | 1/2004 | Takahashi | 439/157 |
| 2002/0182908 | A1 | 12/2002 | Maegawa | |
| 2003/0022539 | A1 * | 1/2003 | Takahashi | 439/157 |
| 2004/0266265 | A1 | 12/2004 | Hayashi | |
| 2006/0240693 | A1 * | 10/2006 | Nishide | 439/157 |
| 2006/0270257 | A1 | 11/2006 | Duval | |
| 2007/0072482 | A1 | 3/2007 | Fujii et al. | |

(Continued)

FOREIGN PATENT DOCUMENTS

| | | | |
|---|---|---|---|
| CN | 1941517 | A | 4/2007 |
| CN | 101283487 | A | 10/2008 |
| DE | 10 2004 029 306 | A1 | 1/2005 |

(Continued)

OTHER PUBLICATIONS

International Search Report dated Aug. 9, 2011 issued in International Application No. PCT/JP2011/065401 (PCT/ISA/210).
Written Opinion dated Aug. 9, 2011 issued in International Application No. PCT/JP2011/065401 (PCT/ISA/237).

(Continued)

*Primary Examiner* — Briggitte R Hammond
(74) *Attorney, Agent, or Firm* — Sughrue Mion, PLLC

(57) ABSTRACT

In a lever type connector 21 in which a female connector housing 25 is provided with a fitting operation lever 29 for pulling a fitting pin 27 projected on a male connector housing 23 in a side of an end of a pin guide groove 30 with rotating operation of the fitting operation lever 29, the side of the end of the pin guide groove 30 is provided with a spring part 61 which makes contact with the fitting pin 27 of the inside of the pin guide groove 30 in an elastic deformation state and regulates relative movement of the fitting operation lever 29 and the fitting pin 27 when fitting between the connector housings 23, 25 is completed.

2 Claims, 10 Drawing Sheets

(56) References Cited

U.S. PATENT DOCUMENTS

| | | | |
|---|---|---|---|
| 2007/0099461 | A1 | 5/2007 | Pittenger et al. |
| 2009/0163059 | A1 | 6/2009 | Kobayashi |

FOREIGN PATENT DOCUMENTS

| | | | |
|---|---|---|---|
| EP | 0 544 558 | A1 | 6/1993 |
| JP | 2003-17190 | A | 1/2003 |
| JP | 200511647 | A | 1/2005 |
| JP | 200624457 | A | 1/2006 |
| JP | 2009158151 | A | 7/2009 |
| JP | 2009193876 | A | 8/2009 |

OTHER PUBLICATIONS

Office Action dated Nov. 18, 2013 issued by the Korean Intellectual Property Office in counterpart Korean Application No. 1020137000298.

Office Action issued Nov. 20, 2014 by the German Patent Office in corresponding German Application No. 11 2011 102 284.0.

Office Action, Issued by the State Intellectual Property Office of P.R. China, Dated Sep. 25, 2014, In counterpart Chinese Application No. 201180033553.1.

Notification of Reasons for Refusal dated Jun. 23, 2014, issued by the Japanese Patent Office in counterpart Japanese Application No. 2010-153786.

* cited by examiner

LEVER TYPE CONNECTOR

DESCRIPTION

1. Technical Field

A lever type connector including a fitting operation lever for aiding a fitting force is conventionally used in the field of a connector such as a multiple connector requiring a high fitting force.

2. Background Art

FIGS. 9 and 10 show a lever type connector 1 disclosed in the following Patent Reference 1.

This lever type connector 1 includes a first connector housing 3, a second connector housing 5, fitting pins 7, and a fitting operation lever 9.

The first connector housing 3 receives plural first connecting terminals (not shown). The second connector housing 5 receives plural second connecting terminals connected to the first connecting terminals. And, the second connector housing 5 is fitted into the first connector housing 3.

The fitting pins 7 are projected on right and left outside surfaces of the first connector housing 3. Also, the fitting pin 7 includes a pin body 7*a* projecting to an outer lateral part of the first connector housing 3, and a retaining flange part 7*b* formed in a flange shape on the top of this pin body 7*a* as shown in FIG. 10.

The fitting operation lever 9 includes a pair of right and left lever bodies 9*a* that are rotatably attached to lever support shafts 5*a* of right and left outside surfaces of the second connector housing 5, and a rotating operation part 9*b* for joining the pair of right and left lever bodies 9*a*. Then, a pin guide groove 10 which the fitting pin 7 can enter is formed in each of the lever bodies 9*a*.

The pin guide groove 10 includes a groove starting opening 10*a* which the pin body 7*a* of the fitting pin 7 enters in an early stage of fitting between the first connector housing 3 and the second connector housing 5, and a pull-in guide surface 10*b* for pulling the fitting pin 7 in the end side of the groove with rotating of the fitting operation lever 9 in the direction of arrow A.

A dimension of each part is set so that the fitting operation lever 9 functions as a lever capable of pulling the fitting pin 7 by a small rotating operation force at the time of rotating the fitting operation lever 9.

In the lever type connector 1 described above, by rotating and operating the fitting operation lever 9, the fitting pin 7 is relatively moved from the groove starting opening 10*a* toward the end of the pin guide groove 10 and both of the connector housings 3, 5 are fitted.

When a gap for permitting relative movement is left between both of the connector housings 3, 5 in a state in which fitting between both of the connector housings 3, 5 is completed by rotating and operating the fitting operation lever 9 in such a lever type connector 1, a rattle occurs between both of the connector housings 3, 5 due to vibration from the outside or tension acting on a cable connected to the lever type connector 1, and trouble such as occurrence of abnormal noise or poor contact between the connecting terminals may be caused.

Hence, in the case of the lever type connector 1 described above, as measures to prevent the rattle, the width of the pin guide groove 10 is formed so as to become smaller as the pin guide groove 10 is nearer to the end from the inlet as shown in FIG. 9 and further a taper surface 7*c* whose diameter becomes larger as the taper surface 7*c* is nearer to the top from the root is formed on the outer periphery of the pin body 7*a* of the fitting pin 7 as shown in FIG. 10. By such measures in the lever type connector 1, at the time when fitting between both of the mutual connector housings 3, 5 is completed, the pin body 7*a* of the fitting pin 7 becomes closely fitted into the pin guide groove 10 and the rattle is prevented from occurring between both of the connector housings 3, 5.

PRIOR ART REFERENCE

Patent Reference

Patent Reference 1: JP-A-2009-193876

DISCLOSURE OF THE PRESENT INVENTION

Problems That the Present Invention is to Solve

However, in a rattle prevention mechanism in Patent Reference 1, for example, the fitting pin 7 or the pin guide groove 10 requires high fitting accuracy and it becomes necessary to form both of the connector housings 3, 5 or the fitting operation lever 9 with high dimension accuracy. Then, an increase in accuracy of a molding tool for molding both of the connector housings 3, 5 or the fitting operation lever 9 caused a problem of increasing a manufacturing cost.

Also, since sliding friction between the fitting pin 7 and the pin guide groove 10, increases, this caused a problem of requiring a large operation force at the time of rotating and operating the fitting operation lever 9.

Hence, an object of the present invention relates to the solution of the problems described above, and is to provide a lever type connector capable of preventing occurrence of a rattle in a state of the completion of fitting between connector housings and also reducing a manufacturing cost by decreasing accuracy of fitting between a fitting pin and a pin guide groove and further facilitating the fitting between the connector housings by decreasing an operation force.

Means for Solving the Problems

The object of the present invention described above is achieved by the following configuration.

(1) A lever type connector including a first connector housing for receiving a first connecting terminal, a second connector housing which receives a second connecting terminal connected to the first connecting terminal and is fitted into the first connector housing, a fitting pin projected on an outside surface of the first connector housing, and a fitting operation lever which is rotatably attached to a side surface of the second connector housing and has a pin guide groove which the fitting pin can enter, the pin guide groove including a groove starting opening which the fitting pin enters in an early stage of fitting between the first connector housing and the second connector housing, and a pull-in guide surface for pulling the fitting pin in a side of an end of the pin guide groove with rotating of the fitting operation lever, both of the connector housings being fitted by relatively moving the fitting pin from the groove starting opening toward the end of the pin guide groove by rotating and operating the fitting operation lever, wherein the side of the end of the pin guide groove is provided with a spring part which makes contact with the fitting pin of the inside of the pin guide groove in an elastic deformation state and regulates relative movement of the fitting operation lever and the fitting pin when fitting between both of the connector housings is completed.

(2) A lever type connector as described in the above (1), wherein the spring part is a curved wall bulging out from the pull-in guide surface in a direction in which a groove width is narrowed.

According to the configuration of the above (1), the mutual connector housings are fitted by rotating and operating the fitting operation lever from an early state of fitting between the first connector housing and the second connector housing. In that case, the spring part makes contact with the fitting pin positioned in the end of the pin guide groove in the elastic deformation state and regulates the relative movement of the fitting operation lever and the fitting pin when fitting between the connector housings is completed. As a result, occurrence of a rattle in a state of the completion of fitting between the connector housings can be prevented.

Moreover, a groove width of the pin guide groove has only to have, for example, the size in which the fitting pin is loosely fitted in the range of the side of the groove starting opening beyond a site having the spring part, so that accuracy of fitting between the fitting pin and the pin guide groove can be decreased. Therefore, a manufacturing cost can be reduced by decreasing processing accuracy of a molding tool for molding both of the connector housings or the fitting operation lever. Further, the fitting pin has only to be loosely fitted into the pin guide groove except the range in which the fitting pin makes contact with the spring part in a movement path of the fitting pin along the pin guide groove, so that sliding friction between the fitting pin and the pin guide groove can be reduced. Therefore, fitting between the connector housings can be facilitated by decreasing an operation force.

According to the configuration of the above (2), in the spring part, a side wall of the pin guide groove forming the pull-in guide surface has only to be formed in a leaf spring shape convexly curved to the inside of the groove, and the spring part can easily be formed integrally to the fitting operation lever by, for example, injection molding of the fitting operation lever, and a situation in which it becomes difficult to manufacture the fitting operation lever by forming the spring part can be prevented.

MODE FOR CARRYING OUT THE PRESENT INVENTION

A preferred embodiment of a lever type connector according to the present invention will hereinafter be described in detail with reference to the drawings.

Figure 1:
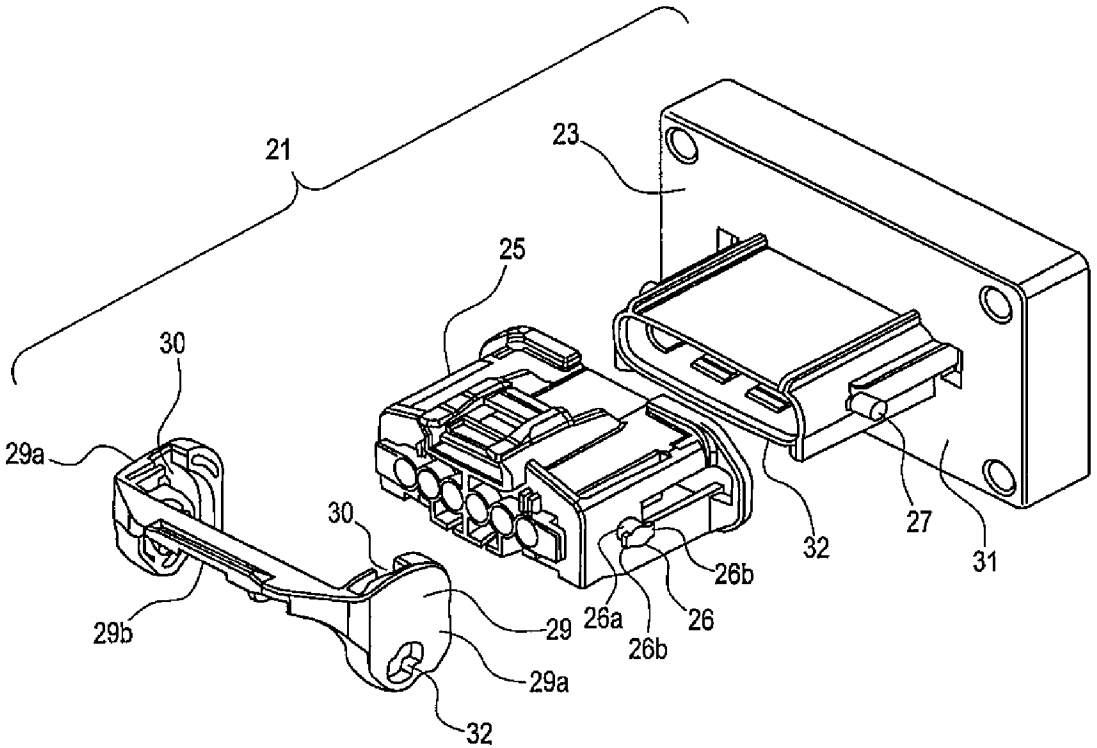
FIG. 1 is an exploded perspective view of one embodiment of a lever type connector according to the present invention.
Figure 2:
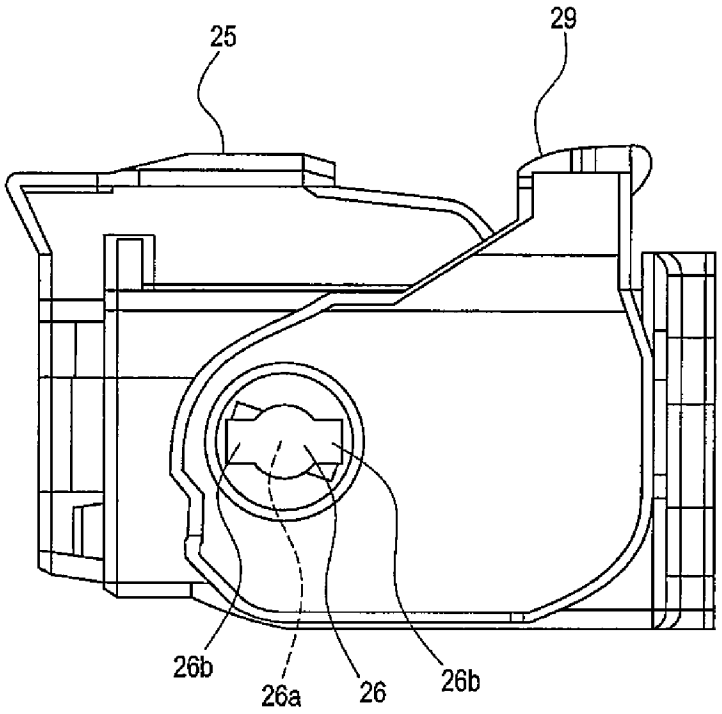
FIG. 2 is a side view of a second connector housing to which a fitting operation lever shown in FIG. 1 is assembled.
Figure 3:
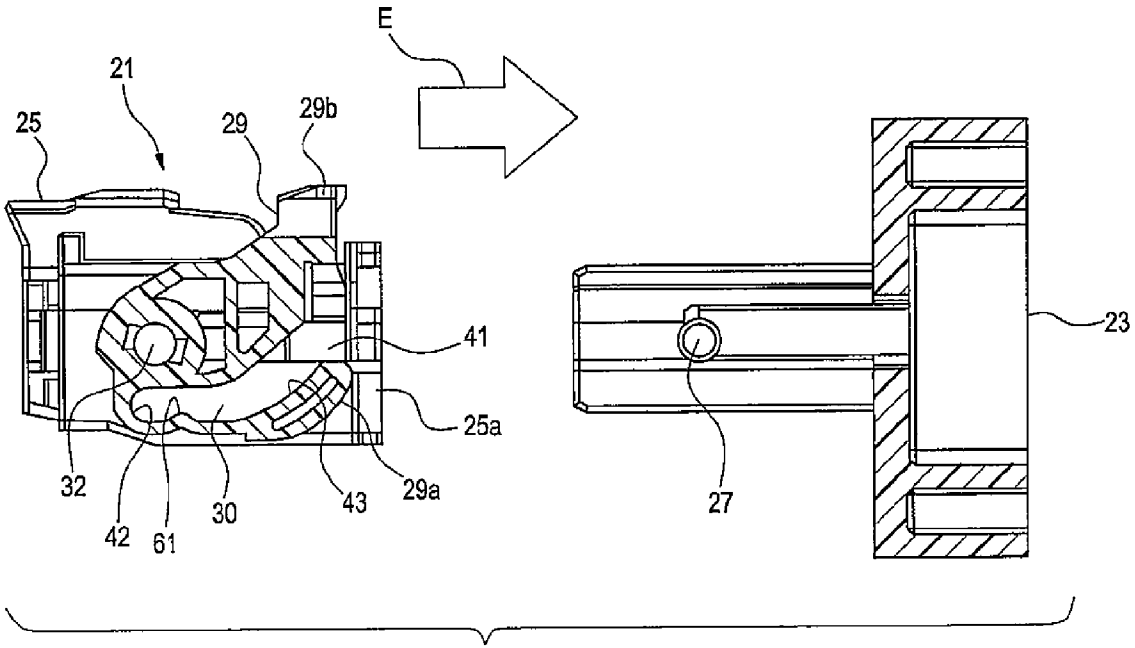
FIG. 3 is a side view showing a positional relation between a fitting pin and a pin guide groove on the fitting operation lever before fitting between the connector housings is started.
Figure 4:
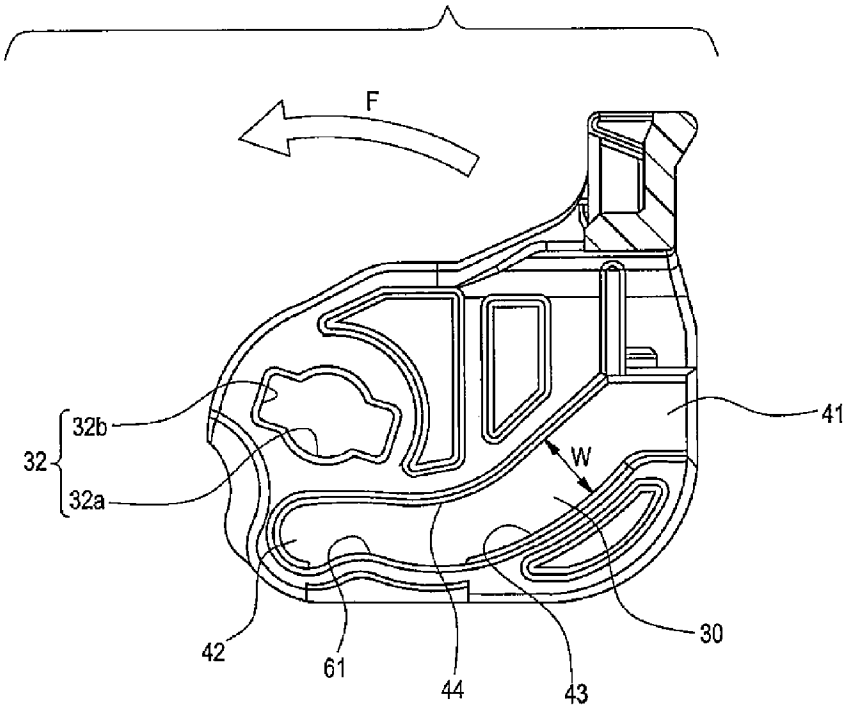
FIG. 4 is an enlarged view of the fitting operation lever shown in FIG. 3.
Figure 5:
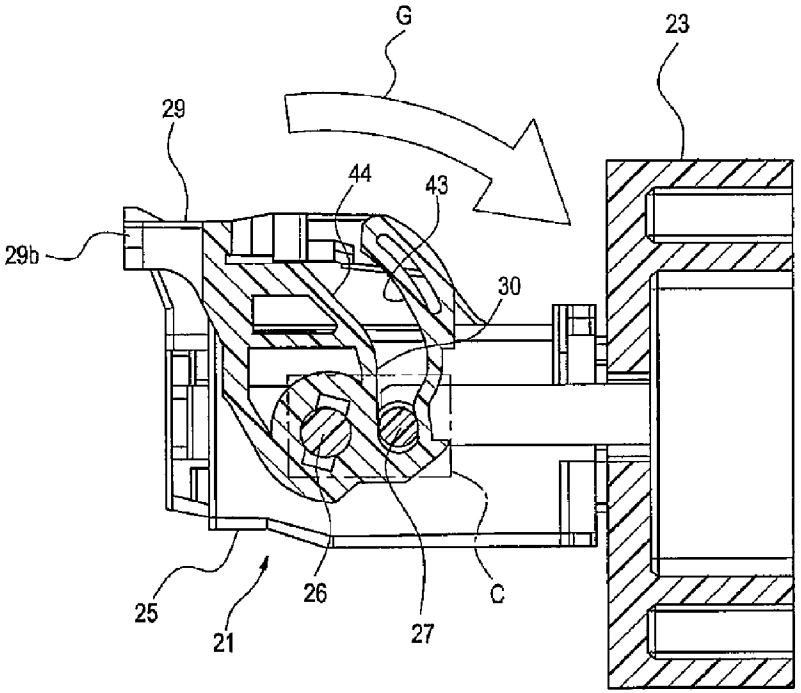
FIG. 5 is a side view of a state in which the mutual connector housings are fitted in a position of the completion of fitting by rotating the fitting operation lever.
Figure 6:
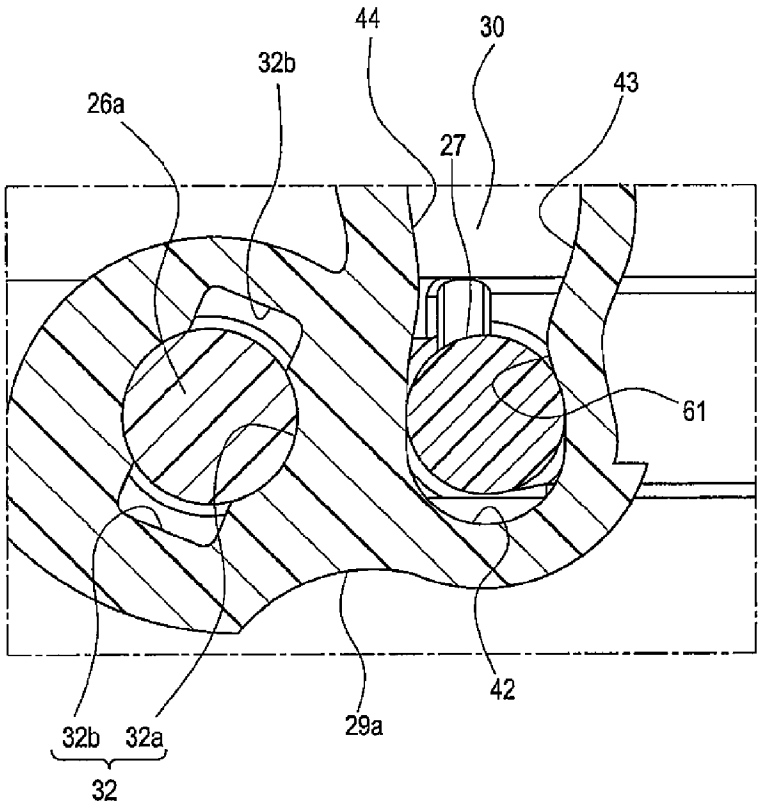
FIG. 6 is an enlarged view of part C of FIG. 5.
Figure 7:
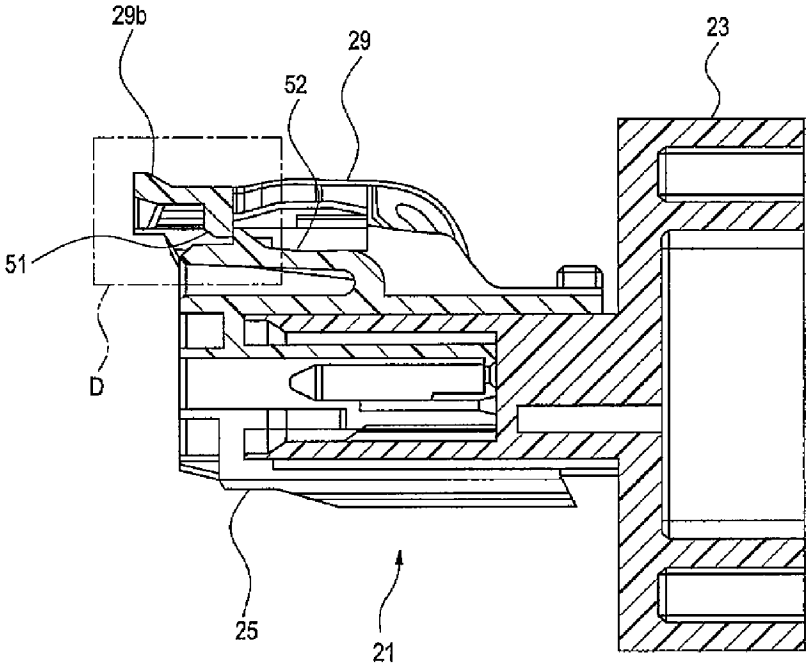
FIG. 7 is a longitudinal sectional view of the connector of a state in which the fitting operation lever rotated to the end of a rotating region in a state of the completion of fitting between the connector housings is locked in the second connector housing.
Figure 8:
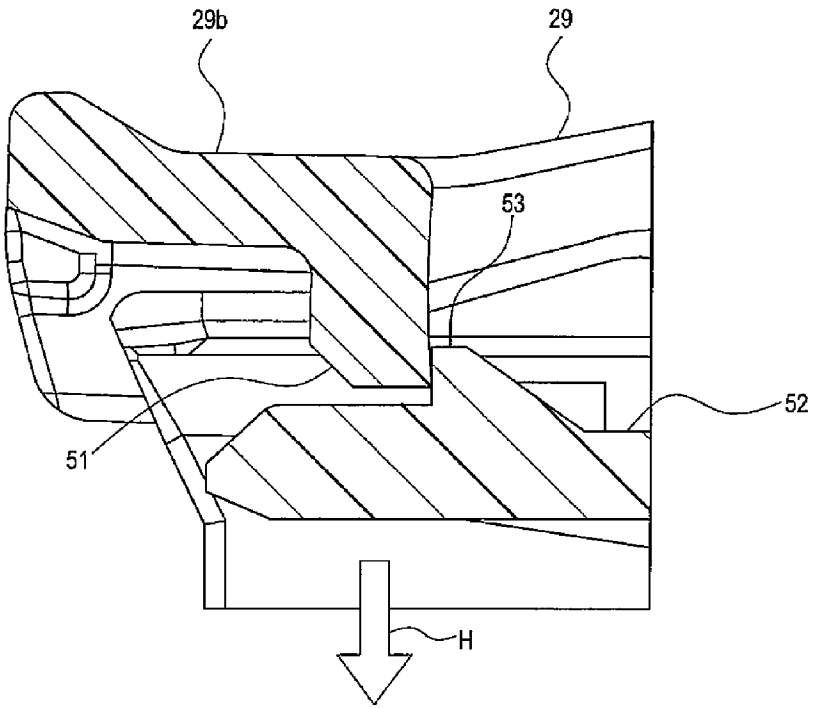
FIG. 8 is an enlarged view of part D of FIG. 7.
Figure 9:
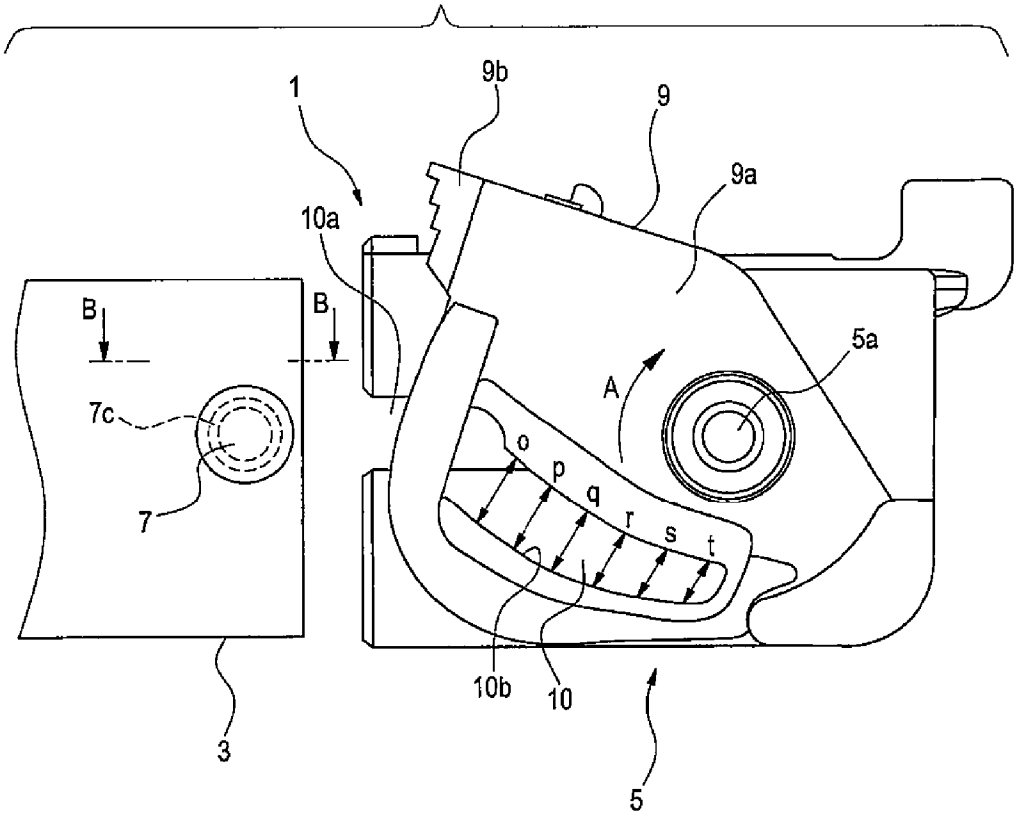
FIG. 9 is a side view of mutual connector housings of a conventional lever type connector.
Figure 10:
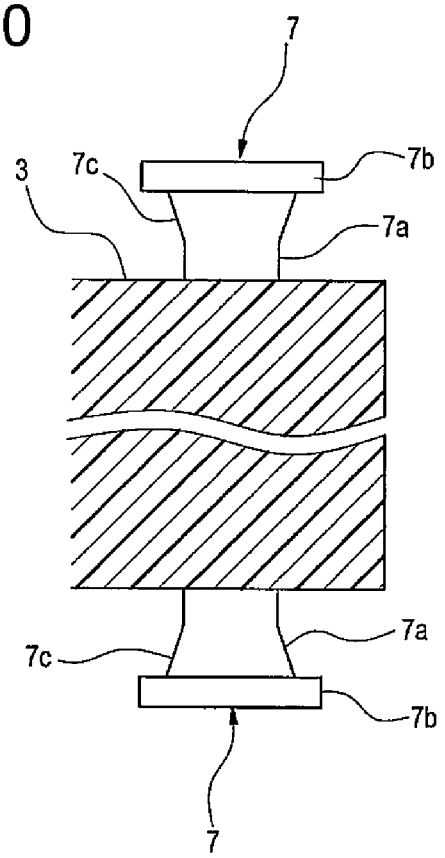
FIG. 10 is a sectional view taken on line B-B shown in FIG. 9.

FIGS. 1 to 8 show one embodiment of a lever type connector according to the present invention, and FIG. 1 is an exploded perspective view of one embodiment of the lever type connector according to the present invention, and FIG. 2 is a side view of a second connector housing to which a fitting operation lever shown in FIG. 1 is assembled, and FIG. 3 is a side view showing a positional relation between a fitting pin and a pin guide groove on the fitting operation lever before fitting between the connector housings is started, and FIG. 4 is an enlarged view of the fitting operation lever shown in FIG. 3, and FIG. 5 is a side view of a state in which the mutual connector housings are fitted in a position of the completion of fitting by rotating the fitting operation lever, and FIG. 6 is an enlarged view of part C of FIG. 5. Also, FIG. 7 is a longitudinal sectional view of the connector of a state in which the fitting operation lever rotated to the end of a rotating region in a state of the completion of fitting between the connector housings is locked in the second connector housing, and FIG. 8 is an enlarged view of part D of FIG. 7.

This lever type connector 21 of one embodiment includes a male connector housing 23 which is a first connector housing, a female connector housing 25 which is a second connector housing fitted into the first connector housing, fitting pins 27, and a fitting operation lever 29.

In the male connector housing 23, a terminal receiving part 32 which is a tubular hood part is vertically erected on a flat base 31. The terminal receiving part 32 receives plural first connecting terminals (male connecting terminals).

The female connector housing 25 receives second connecting terminals (female connecting terminals) connected to the first connecting terminals, and is fitted and connected to the male connector housing 23.

The fitting pins 27 have simple columnar shapes, and are projected on right and left outside surfaces of the terminal receiving part 32 of the male connector housing 23.

The fitting operation lever 29 includes a pair of right and left lever bodies 29*a*, 29*a* rotatably attached to lever support shafts 26 of right and left outside surfaces of the female connector housing 25, and a rotating operation part 29*b* for joining the pair of right and left lever bodies 29*a*, 29*a*. Then, a pin guide groove 30 which the fitting pin 27 can enter is formed in each of the lever bodies 29*a*, 29*a*.

Each of the lever support shafts 26 of right and left outside surfaces of the female connector housing 25 includes a columnar shaft body 26*a*, and a pair of retaining protrusion pieces 26*b*, 26*b* extending from radially opposed positions of the top of this shaft body 26*a* to the radial outside as shown in FIGS. 1 and 2.

The lever body 29*a* is provided with a pivot hole 32 rotatably fitted into the lever support shaft 26 of the female connector housing 25 as shown in FIGS. 3 and 4. The pivot hole 32 includes a circular bearing hole 32*a* into which the columnar shaft body 26*a* is rotatably fitted without a rattle, and a pair of protrusion piece insertion parts 32*b* in which opposed positions of the pivot hole 32 are opened toward the radial outside so that the retaining protrusion pieces 26*b* can be inserted as shown in FIG. 6.

In the lever type connector 1 of the embodiment, as shown by arrow E in FIG. 3, a state in which the female connector housing 25 to which the fitting operation lever 29 is attached is butted against the male connector housing 23 and the tops of the mutual connector housings start to be fitted is an early state of fitting.

In the early state of fitting, the rotating operation part 29*b* of the fitting operation lever 29 assembled to the female connector housing 25 is positioned in the side of a front end 25*a* of the female connector housing 25 as shown in FIG. 3.

The pin guide groove 30 includes a groove starting opening 41, an end 42 of the pin guide groove 30, a pull-in guide surface 43, and a push-out guide surface 44 as shown in FIG. 4.

The groove starting opening 41 is opened toward the side of the male connector housing 23 so that the fitting pin 27 enters in an early stage of fitting of the female connector housing 25 at the start of the pin guide groove 30. The end 42 of the pin guide groove 30 is a region in which the fitting pin 27 is positioned when fitting between a pair of connector housings 23, 25 is completed, and reaches a dead end. The pull-in guide surface 43 pulls the fitting pin 27 in the side of the end 42 of the pin guide groove 30 with rotating of the fitting operation lever 29 when the fitting operation lever 29 is rotated in a counterclockwise direction (direction of arrow F of FIG. 4) in FIGS. 3 and 4 from the early state of fitting shown in FIG. 3.

By pulling the fitting pin 27 in the side of the end 42 of the pin guide groove 30, the fitting pin 27 is relatively moved from the groove starting opening 41 toward the end 42 of the pin guide groove 30, and fitting between a pair of connector housings 23, 25 becomes deep. When fitting between a pair of connector housings 23, 25 is completed by rotating the fitting operation lever 29, the rotating operation part 29*b* of the fitting operation lever 29 is moved to the side of a back end of the female connector housing 25 as shown in FIG. 5.

In a fitting completion state in which the rotating operation part 29*b* of the fitting operation lever 29 is moved to the side of a back end 25*b* of the female connector housing 25, a step 51 for locking mounted in the rotating operation part 29*b* engages with a locking protrusion 53 of a lock arm 52 extended on an upper surface of the female connector housing 25 to obtain a locked state in which rotating of the fitting operation lever 29 in a return direction is regulated as shown in FIGS. 7 and 8.

The locked state by the lock arm 52 is released by bending the lock arm 52 downwardly (in a direction of arrow H of FIG. 8) and disengaging the step 51 for locking from the locking protrusion 53.

When the fitting operation lever 29 is rotated in a direction of arrow G of FIG. 5 in a state in which the locked state by the lock arm 52 is released, the push-out guide surface 44 pushes the fitting pin 27 on the side of the male connector housing 23, and fitting between a pair of connector housings 23, 25 becomes shallow gradually with rotating of the fitting operation lever 29. When the rotating operation part 29*b* is moved to the side of the front end 25*a* of the female connector housing 25 by rotating the fitting operation lever 29 as shown in FIGS. 2 and 3, the fitting pin 27 is rerotated to the groove starting opening 41 and a pair of connector housings 23, 25 can mutually be separated.

In the case of the embodiment, a groove width W of the pin guide groove 30 is set larger than an outside diameter of the fitting pin 27 over substantially the whole length of the groove at a separation distance between the pull-in guide surface 43 and the push-out guide surface 44 as shown in FIG. 4.

However, in the case of the embodiment, the side of the end 42 of the pin guide groove 30 is provided with a spring part 61 as shown in FIG. 4.

This spring part 61 makes contact with the fitting pin 27 of the inside of the pin guide groove 30 in an elastic deformation state and regulates relative movement of the fitting operation lever 29 and the fitting pin 27 when fitting between the connector housings 23, 25 is completed as shown in FIG. 6.

In the case of the embodiment, the spring part 61 is a curved wall bulging out from the pull-in guide surface 43 in a direction (direction toward the push-out guide surface 44) in which the groove width is narrowed as shown in FIG. 6.

In the lever type connector 21 of one embodiment described above, the mutual connector housings 23, 25 are fitted by rotating and operating the fitting operation lever 29 in the direction of arrow F shown in FIG. 4 from the early state of fitting between the male connector housing 23 and the female connector housing 25. In that case, the spring part 61 makes contact with the fitting pin 27 positioned in the end of the pin guide groove 30 in an elastic deformation state and regulates relative movement of the fitting operation lever 29 and the fitting pin 27 when fitting between the connector housings 23, 25 is completed as shown in FIGS. 5 and 6. As a result, occurrence of a rattle in a state of the completion of fitting between the connector housings 23, 25 can be prevented.

Moreover, the groove width W of the pin guide groove 30 has only to have, for example, the size in which the fitting pin 27 is loosely fitted in the range of the side of the groove starting opening 41 beyond a site having the spring part 61, so that accuracy of fitting between the fitting pin 27 and the pin guide groove 30 can be decreased. Therefore, a manufacturing cost can be reduced by decreasing processing accuracy of a molding tool for molding both of the connector housings 23, 25 or the fitting operation lever 29.

Further, the fitting pin 27 has only to be loosely fitted into the pin guide groove 30 except the range in which the fitting pin 27 makes contact with the spring part 61 in a movement path of the fitting pin 27 along the pin guide groove 30, so that sliding friction between the fitting pin 27 and the pin guide groove 30 can be reduced. Therefore, fitting between the connector housings 23, 25 can be facilitated by decreasing an operation force.

Also in the lever type connector 21 of one embodiment described above, in the spring part 61, a side wall of the pin guide groove 30 forming the pull-in guide surface 43 has only to be formed in a leaf spring shape convexly curved to the inside of the groove as shown in FIG. 6, and the spring part 61 can easily be formed integrally to the fitting operation lever 29 by, for example, injection molding of the fitting operation lever 29, and a situation in which it becomes difficult to manufacture the fitting operation lever 29 by forming the spring part 61 can be prevented.

In addition, in the lever type connector according to the present invention, a position in which the spring part 61 is formed is not limited to the embodiment described above. For example, the spring part 61 may be formed in the push-out guide surface 44.

Further, in the lever type connector of the embodiment, for example, a structure of locking the fitting operation lever in a state of the completion of fitting between a pair of connector housings 23, 25 is not limited to the embodiment described above, and design can be changed properly without departing from the gist of the present invention.

The lever type connector of the present invention is not limited to the embodiment described above, and proper modifications, improvements, etc. can be made. Also, as long as the present invention can be achieved, the number of components, materials, shapes, dimensions, numerical values, modes, arrangement places, etc. in each component constructing the lever type connector of the present invention are arbitrary and are not limited.

The present invention has been described in detail with reference to the specific embodiment, but it is apparent to those skilled in the art that various changes or modifications can be made without departing from the spirit and scope of the present invention.

The present application is based on Japanese patent application (patent application No. 2010-153786) filed on Jul. 6, 2010, and the contents of the patent application are hereby incorporated by reference.

Industrial Applicability

According to a lever type connector according to the present invention, a spring part makes contact with a fitting pin positioned in an end of a pin guide groove in an elastic deformation state and regulates relative movement of a fitting operation lever and the fitting pin when fitting between connector housings is completed by rotating and operating the fitting operation lever. As a result, occurrence of a rattle in a state of the completion of fitting between the connector housings can be prevented.

Moreover, accuracy of fitting between the fitting pin and the pin guide groove can be decreased, so that a manufacturing cost can be reduced by decreasing processing accuracy of a molding tool for molding both of the connector housings or the fitting operation lever. Further, the fitting pin has only to be loosely fitted into the pin guide groove except the range in which the fitting pin makes contact with the spring part in a movement path of the fitting pin along the pin guide groove, so that sliding friction between the fitting pin and the pin guide groove can be reduced. Therefore, fitting between the connector housings can be facilitated by decreasing an operation force.

DESCRIPTION OF REFERENCE NUMERALS AND SIGNS

21 LEVER TYPE CONNECTOR
23 MALE CONNECTOR HOUSING (FIRST CONNECTOR HOUSING)
25 FEMALE CONNECTOR HOUSING (SECOND CONNECTOR HOUSING)
26 LEVER SUPPORT SHAFT
27 FITTING PIN
29 FITTING OPERATION LEVER
**29*a*** LEVER BODY
**29*b*** ROTATING OPERATION PART
30 PIN GUIDE GROOVE
41 GROOVE STARTING OPENING
42 END OF PIN GUIDE GROOVE
43 PULL-IN GUIDE SURFACE
44 PUSH-OUT GUIDE SURFACE
61 SPRING PART

The invention claimed is:

1. A lever type connector, comprising:

a first connector housing receiving a first connecting terminal;

a second connector housing receiving a second connecting terminal connected to the first connecting terminal and fitted into the first connector housing;

a fitting pin projected on an outside surface of the first connector housing; and a fitting operation lever rotatably attached to a side surface of the second connector housing and having a pin guide groove which the fitting pin is to be entered;

wherein the pin guide groove including a groove starting opening which the fitting pin enters in an early stage of fitting between the first connector housing and the second connector housing, and a pull-in guide surface for pulling the fitting pin in a side of an end of the pin guide groove with rotating of the fitting operation lever, and a push-out guide surface in opposition to the pull-in guide surface;

both of the connector housings are fitted by relatively moving the fitting pin from the groove starting opening toward the end of the pin guide groove by rotating and operating the fitting operation lever;

the side of the end of the pin guide groove is provided with a spring part which makes contact with the fitting pin of an inside of the pin guide groove in an elastic deformation state and regulates relative movement of the fitting operation lever and the fitting pin when fitting between both of the connector housings is completed; and a width of the pin guide groove is set larger than an outside diameter of the fitting pin over a whole length of the pin guide groove at a separation distance between the pull-in guide surface and the push-out guide surface.

2. The lever type connector according to claim 1, wherein the spring part is a curved wall bulging out from the pull-in guide surface in a direction in which a groove width is narrowed.

* * * * *